US010335809B2

(12) United States Patent
Prus et al.

(10) Patent No.: US 10,335,809 B2
(45) **Date of Patent: *Jul. 2, 2019**

(54) ROTATING PROJECTOR AND METHOD FOR SPRAYING A COATING PRODUCT

(71) Applicant: SAMES TECHNOLOGIES, Meylan (FR)

(72) Inventors: Eric Prus, Grenoble (FR); Sylvain Perinet, Giez (FR); David Vincent, Grenoble (FR); Olivier Gourbat, Saint Egreve (FR)

(73) Assignee: SAMES KREMLIN, Meylan (FR)

( * ) Notice: Subject to any disclaimer, the term of this patent is extended or adjusted under 35 U.S.C. 154(b) by 65 days.

This patent is subject to a terminal disclaimer.

(21) Appl. No.: 14/391,309

(22) PCT Filed: Apr. 12, 2013

(86) PCT No.: PCT/EP2013/057699

§ 371 (c)(1),
(2) Date: Oct. 8, 2014

(87) PCT Pub. No.: WO2013/153205

PCT Pub. Date: Oct. 17, 2013

(65) Prior Publication Data

US 2015/0110964 A1 Apr. 23, 2015

(30) Foreign Application Priority Data

Apr. 13, 2012 (FR) ..... 12 53420

(51) Int. Cl.
*B05B 3/02* (2006.01)
*B05B 5/04* (2006.01)
*B05D 1/02* (2006.01)

(52) U.S. Cl.
CPC ..... *B05B 3/028* (2013.01); *B05B 5/0426* (2013.01); *B05D 1/02* (2013.01)

(58) Field of Classification Search
None
See application file for complete search history.

(56) References Cited

U.S. PATENT DOCUMENTS 9,314,806 B2 * 4/2016 Ballu ..... B05B 3/1092
2010/0021646 A1 1/2010 Nolte et al.
(Continued)

FOREIGN PATENT DOCUMENTS

EP 2042242 A1 1/2009
EP 2058053 A1 5/2009
(Continued)

OTHER PUBLICATIONS

International Search Report for PCT/EP2013/057699 dated May 28, 2013.
French Search Report for FR 1253420 dated Oct. 22, 2012.

*Primary Examiner* — Charles Capozzi
(74) *Attorney, Agent, or Firm* — Pearne & Gordon LLP

(57) ABSTRACT

Rotating projector for a coating product including a spraying device having a circular spraying edge, driving means for driving the spraying device around a rotational axis, a body including primary openings arranged on a primary contour for ejecting primary air jets in a primary direction. The air jets having an axial component and an orthoradial component which are nonzero. The primary direction has a nonzero radial component, which is centrifugal relative to the rotation axis. Each primary jet extends along the rotational axis at a distance from the rotational axis than the radius of the spraying edge. The body includes secondary openings arranged on a secondary contour for ejecting the secondary air jets in a secondary direction having axial and centripetal radial components. The secondary jets hit an external surface of the spraying device. The contours coincide with a circle centered about the rotation axis.

7 Claims, 4 Drawing Sheets

(56) References Cited

U.S. PATENT DOCUMENTS

| | | | | |
|---|---|---|---|---|
| 2010/0192848 | A1* | 8/2010 | Ballu | B05B 3/1092 118/323 |
| 2011/0210180 | A1* | 9/2011 | Perinet | B05B 3/1092 239/1 |

FOREIGN PATENT DOCUMENTS

| | | | |
|---|---|---|---|
| JP | 08084941 | | 2/1996 |
| JP | 08-99052 | A | 4/1996 |
| JP | 09094488 | | 8/1997 |
| JP | 2000070769 | A | 3/2000 |
| JP | 2005-246290 | A | 9/2005 |
| JP | 2008-93521 | A | 4/2008 |
| JP | 2009/112932 | A1 | 9/2009 |
| JP | 2009-214065 | A | 9/2009 |
| JP | 2012-115736 | A | 6/2012 |
| WO | 2008010451 | A1 | 1/2008 |
| WO | 2009112932 | A1 | 9/2009 |

* cited by examiner

ROTATING PROJECTOR AND METHOD FOR SPRAYING A COATING PRODUCT

CROSS-REFERENCE TO RELATED APPLICATIONS

This application is a National Stage application of PCT international application PCT/EP2013/057699, filed on Apr. 12, 2013 which claims the priority of French Patent Application No. 1253420 entitled "ROTATING PROJECTOR AND METHOD FOR SPRAYING A COATING PRODUCT", filed with the French Patent Office on Apr. 13, 2012, both of which are incorporated herein by reference in their entirety.

BRIEF SUMMARY OF THE INVENTION

The invention relates to a rotating projector for a coating product that comprises, among other items, a spraying device provided to be driven in rotation around a rotational axis. The invention also relates to a method for spraying a coating product onto a surface of an object to be coated, using a rotating projector such as mentioned hereinabove.

Conventional spraying by means of rotating projectors is used to apply onto objects to be coated, such as motor vehicle bodies, a primer, a base coat and/or a varnish. To do this, a rotating projector is used that comprises a spraying device rotating at high speed, under the effect of driving means in rotation, such as a compressed air turbine.

Such a spraying device generally has the shape of a bowl with rotational symmetry and comprises at least one spraying edge from which a jet of coating product is formed. This jet of coating product has a generally tapered shape that depends, among other items, on the speed of rotation of the spraying device and on the flow of the coating product. In order to control the shape of this jet of product, it is known to provide a rotating projector with openings that make it possible to emit jets of air that together form a conformation skirt of air.

JP-A-8071455 describes a rotating projector provided with primary openings intended to emit primary air jets that are inclined with respect to the rotational axis of a bowl, in a primary direction having an axial component and an orthoradial component which are not equal to zero. The primary air jets as such generate a swirling flow of air, sometimes qualified as a "vortex" around the rotational axis of the bowl.

WO-A-2009/010646 teaches to simultaneously use primary air jets that constitute a vortex or swirling skirt and secondary air jets that hit an external surface of the spraying device, which allows for a fine and uniform adjustment of the jet of product sprayed from the spraying edge.

WO-A-2010/037972 provides to mix primary air jets and secondary air jets in order to form combined jets, in a region of intersection of these jets located upstream of the edge of a spraying device. This makes it possible to obtain relatively high transfer efficiencies of deposit, as well as good robustness of the impacts of coating product on the surfaces of the objects to be coated.

EP-A-2 058 053 teaches to use jets of air exiting from openings arranged on two concentric and separate circles and which are oriented according to directions which are all, either centrifugal, or centripetal, with respect to a rotational axis of a bowl.

WO-A-2009/112 932 provides to use jets exiting from openings located on a first circle of small diameter, according to a diverging direction and without interaction with a bowl, as well as jets extending according to a direction parallel to the rotational axis of the bowl in a plane radial to this axis.

With known sprayers, it is difficult to obtain a jet of coating product that is both wide and stable. Indeed, the performance of a sprayer is characterised by transfer efficiency of application (TEA) which is the product of the pitch of the trajectory of the centre of a sprayer, with respect to a surface to be coated, by the speed of displacement of this sprayer over this trajectory. This transfer efficiency application corresponds to the surface swept by the projector per unit of time, with this surface being expressed in $m^2$/mn. In practice, the pitch and the speed of displacement of a projector are chosen in such a way as to guarantee good application of the coating product, responding to the quality specifications required.

The impact width of a jet of coating product is defined as being equal to the width of a layer of coating product applied under the effect of this jet, measured in a zone where this layer has a thickness equal to half of its maximum thickness. For reasons of economy, high transfer efficiency applications are sought in order to optimise the number of projectors, the number of robots that support these projectors and the length of the spray booths.

Projectors that make it possible to obtain impact widths greater than 400 mm are known. This type of projector uses a relatively low flow of skirt of air or air of conformation, which hardly drives back the jet of coating product in the direction of the rotational axis of the spraying device. These jets with wide impact are sometimes referred to as "soft pattern". Projectors that generate this type of jet cannot be displaced at a high speed with respect to the surfaces to be coated; otherwise the jet of coating product can be "torn", i.e. it can be rendered inhomogeneous, to the extent that a substantial portion of the droplets of paint that form this jet do not reach the target. In this case, the transfer efficiency of deposit falls and the quantity of paint that is not deposited onto the object to be coated pollutes the booth and the robot which displaces the projector, which requires later retreatment operations.

On the other hand, if the flow of the skirt of air is increased, the jet of coating product is better channelled between the edge of the spraying device and the object to be coated. However, this increase in the flow of the skirt of air has for effect to tighten the impact, in such a way that the pitch of the trajectory of the projector must be decreased, which, at the same robot speed, increases the cycle time.

Another method that makes it possible to obtain a relatively wide impact consists in moving the projector away from the surface to be coated, taking into account that the jet of coating product globally has the shape of a truncated cone. However, this approach substantially decreases the transfer efficiency of deposit since a non-negligible portion of the droplets of paint does not reach the target.

It is with regards to these disadvantages and limitations that this invention intends to respond to, more particularly by proposing a rotating projector for a coating product that generates a large and stable jet of coating product, as such making it possible to rapidly coat relatively large surfaces, with high displacement speeds of the projector with respect to these surfaces.

To this effect, the invention relates to a rotating projector for a coating product comprising a spraying device of the coating product having at least one circular spraying edge, means for driving the spraying device around a rotational axis and a body that defines the rotational axis and which comprises primary openings arranged on a primary contour surrounding the rotational axis, with each primary opening being intended for ejecting a primary air jet in a primary direction having, with respect to the rotational axis, an axial component and an orthoradial component which are not equal to zero. The primary direction has a radial component which is not equal to zero and centrifugal with respect to the rotational axis, while a primary jet extends, at the spraying edge and along the rotational axis, at a distance from the rotational axis which is strictly greater than the radius of the spraying edge. In accordance with the invention, the body of the projector comprises secondary openings arranged on a secondary contour surrounding the rotational axis, each secondary opening being intended for ejecting a secondary air jet in a secondary direction having, with respect to the rotational axis, an axial component and a centripetal radial component which are not equal to zero, such that the secondary jet hits an external surface of the spraying device, while the primary and secondary contours coincide with a circle centred about the rotational axis.

The invention takes advantage of the fact that the vortex skirt of air can be used to conform the jet with good stability, provided there is a sufficient flow of a skirt of air, and by producing a relatively substantial impact width, thanks to the fact that the primary direction has a radial component which is not equal to zero and centrifugal. Indeed, this radial component, which is not equal to zero and centrifugal, of the primary direction induces that the skirt of air tends to conform the jet coming from the spraying edge with a flared shape, which induces a jet having a substantial impact width. This substantial impact width makes it possible to bring the spraying device closer to the surface to be coated, which provides good homogeneity of the portion of the jet of coating product that reaches the surface of the object to be coated. Note that the invention goes against the habits in the field of spraying a coating product since it is customary to use a skirt of air, in particular a vortex, to drive back the jet of coating product coming from the spraying edge in the direction of the rotational axis of the spraying device. On the contrary, according to this invention, the skirt of air is used to "dilate" or "open" the jet of coating product, in such a way as to obtain a wide impact. Thanks to the invention, the secondary jets lap against the external surface of the spraying device, before reaching the spraying edge where they interact with the jet of coating product (exiting this edge).

Advantageously, the primary direction forms, in a plane radial with respect to the rotational axis, an angle between 0 and 30°, more preferably between 3 and 12°, The invention also relates to a method for spraying a coating product that can be implemented with a projector such as mentioned hereinabove. More precisely this method is used for the spraying of a coating product onto a surface of an object to be coated, using a rotating projector comprising a spraying device of the coating product having at least one circular spraying edge of which the diameter is between 50 and 100 mm, means for driving the spraying device around a rotational axis and a body which defines the aforementioned rotational axis. In this method, during spraying, the coating product sprayed from the circular edge is subjected to the action of primary jets each directed in a primary direction having, with respect to the rotational axis, an axial component and an orthoradial component which is not equal to zero. In accordance with the invention, the primary direction has a radial component which is not equal to zero and centrifugal with respect to the rotational axis. Furthermore, a primary jet extends, at the spraying edge and along the rotational axis, at a distance that is strictly greater than the radius of the circular spraying edge. The circular spraying edge is arranged at an axial distance from the surface of the object to be coated, measured parallel to the rotational axis, which is less than 200 mm, preferably less than 180 mm, more preferably less than 150 mm. The coating product is subjected to the action of secondary jets each directed in a secondary direction and having, with respect to the rotational axis, an axial component and a centripetal radial component which are not equal to zero, with these jets hitting an external surface of the spraying device. The primary and secondary jets exit from primary and secondary openings that are arranged on primary and secondary contours coinciding with a circle centred about the rotational axis of the spraying device.

Thanks to the method of the invention, a relatively stretched impact, which can be qualified as a "hard pattern" is obtained under the action of the primary jets and of the secondary jets and with a relatively substantial impact width, due to the centripetal orientation of the primary direction and the centripetal orientation of the direction of the secondary jets, before they hit the external surface of the spraying device, while the low axial distance between the spraying device and the object to be coated guarantees a good transfer efficiency of deposit since the droplets constituting the jet of coating product remain under the influence of the skirt of air during their entire path to the surface to be coated.

According to advantageous but not mandatory aspects of the invention, such a method can incorporate one or several of the following characteristics taken in any technically permissible combination:

- the total flow of the primary jets is between 100 and 500 liters/mn.
- the total flow of the secondary jets is between 100 and 500 liters/mn.
- The flow of the primary jets, where applicable the flow of the secondary jets and the rotation speed of the spraying device are regulated in such a way that the speed of the droplets of coating products exiting the circular edge is greater than 5 m/s, while the speed of displacement of the projector with respect to the surface of the object to be coated is between 0.2 and 2 m/s.

The invention shall be better understood and other advantages of the latter shall appear more clearly when reading the following description of an embodiment of a projector in accordance with its principle and of a method of implementing this projector also in accordance with its principle, given solely as an example and in reference to the annexed drawings wherein:

DESCRIPTION OF EXAMPLE EMBODIMENTS

Figure 1:
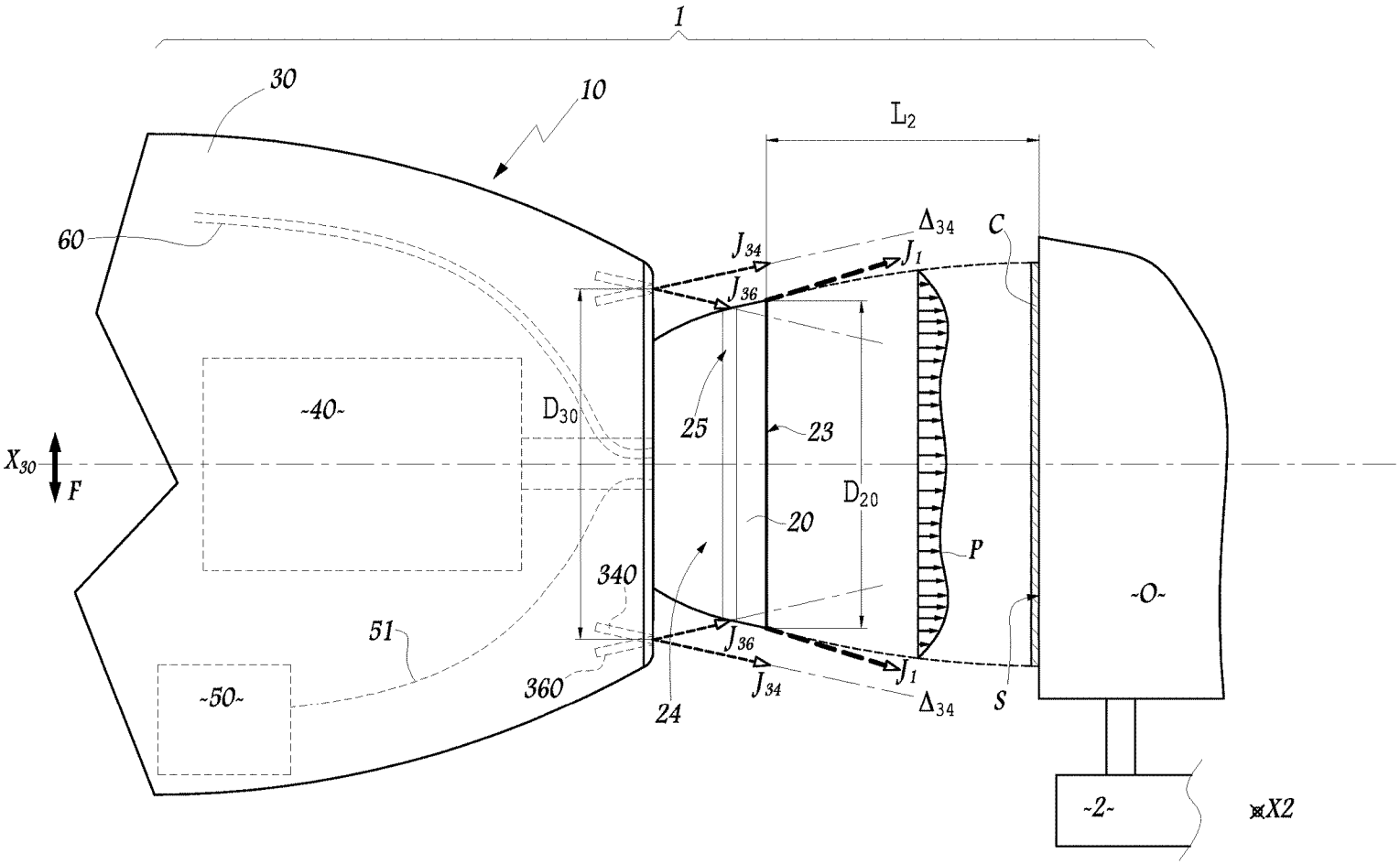
FIG. 1 shows a block diagram of an electrostatic installation for spraying a coating product comprising a rotating projector in accordance with the invention.
Figure 2:
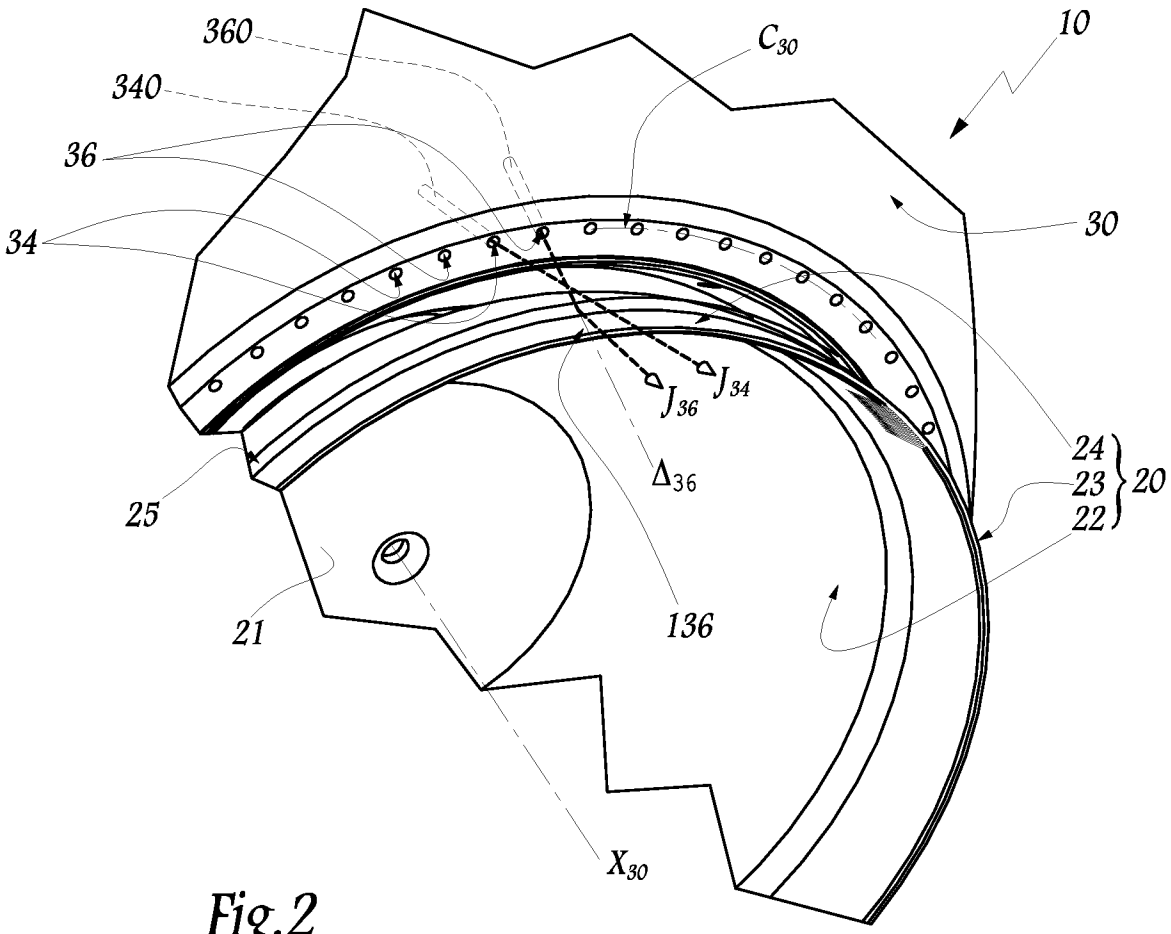
FIG. 2 is a perspective partial view of the projector of the installation of FIG. 1.

The installation 1 shown in FIG. 1 comprises a conveyor 2 able to displace objects O to be coated along an axis X2 perpendicular to the plane of FIG. 1. In the example of the figures, the object O displaced by the conveyor 2 is a motor vehicle body.

The installation 1 also comprises a projector 10 of the rotating and electrostatic type and which comprises a bowl 20 forming a spraying device and supported by a body 30 inside of which a turbine 40 is mounted for driving in rotation the bowl 20 about an axis $X_{30}$ defined by the body 30.

The body 30 also encompasses a high voltage unit 50 connected to the bowl 20 by a high voltage cable 51 and a duct 60 for supplying the bowl 20 with the coating product to be sprayed.

A distributor 21 is integral with the upstream portion of the bowl 20 in order to channel and distribute the coating product, the rotation speed of the bowl 20 loaded, i.e. when it sprays the product, is between 20,000 rpm and 80,000 rpm.

The bowl 20 has a rotational symmetry about the axis $X_{30}$ and comprises a distribution surface 22 whereon the coating product is spread, under the effect of the centrifugal force, towards a spraying edge 23 where it is micronized into fine droplets. All of the droplets form a jet $J_1$ of product exiting the bowl 20, at its edge 23 and moving towards the object O whereon it covers an impact surface S with a layer C of coating product of which the thickness is exaggerated in FIG. 1, for the clarity of the drawing.

The external rear surface 24 of the bowl 20, i.e. its surface that is not turned towards its rotational axis $X_{30}$, is turned towards the body 30.

The body 30 has primary openings 34 and secondary openings 36 arranged on the same circle $C_{30}$ centred on the axis $X_{30}$. These primary 34 and secondary 36 openings are intended to emit respectively primary air jets $J_{34}$ and secondary air jets $J_{36}$ that extend, at the output of the openings 34 and 36, according to their respective directions $\Delta_{34}$ and $\Delta_{36}$. The openings 34 and 36 are arranged alternately along the circle $C_{30}$. In other terms, each opening 34 is arranged, along the circle $C_{30}$, between two openings 36, and reciprocally.

The openings 34 are arranged according to a primary contour, while the openings 36 are arranged according to a secondary contour, with these primary and secondary contours coinciding with the circle $C_{30}$. Thanks to the fact that the first and second contours coincide, the front face of the body 30, wherein the openings 34 and 36 are arranged, can have a low radial width. Its surface area is therefore low although this is the portion of the projector that is exposed the most to dirt. Furthermore, the thinner this front face is radially, the less substantial the zone is wherein, before this face, a depression by Venturi effect is created.

Along the axis $X_{30}$, the edge 23 is at an axial distance $L_1$ from the circle C which here is substantially 10 mm. The distance $L_1$ therefore shows the exceeding of the bowl 20 outside of the body 30.

The primary $\Delta_{34}$ and secondary $\Delta_{36}$ directions are determined respectively by the inclinations, with respect to the axis $X_{30}$, of primary channels 340 and of secondary channels 360 defined in the body 2. These channels 340 and 360 are straight and open respectively onto the primary 34 and secondary 36 openings. Upstream, the channels 340 and 360 are connected to two independent sources for supplying compressed air known per se and which make it possible to form the jets $J_{34}$ and $J_{36}$. These sources, as well as the means for supplying with air channels 340 and 360 are not shown, for the clarity of the drawing. They can be of the type of those represented in FIG. 4 of WO-A-2009/010646.

During operation of the projector 10, the channels 340 are supplied with a pressure and a flow of air such that the total flow of the primary jets is between 100 and 500 liters/mn.

During operation, the channels 360 are supplied with a pressure and a flow of air such that the total flow of the secondary jets is between 100 and 500 liters/mn.

Figure 3:
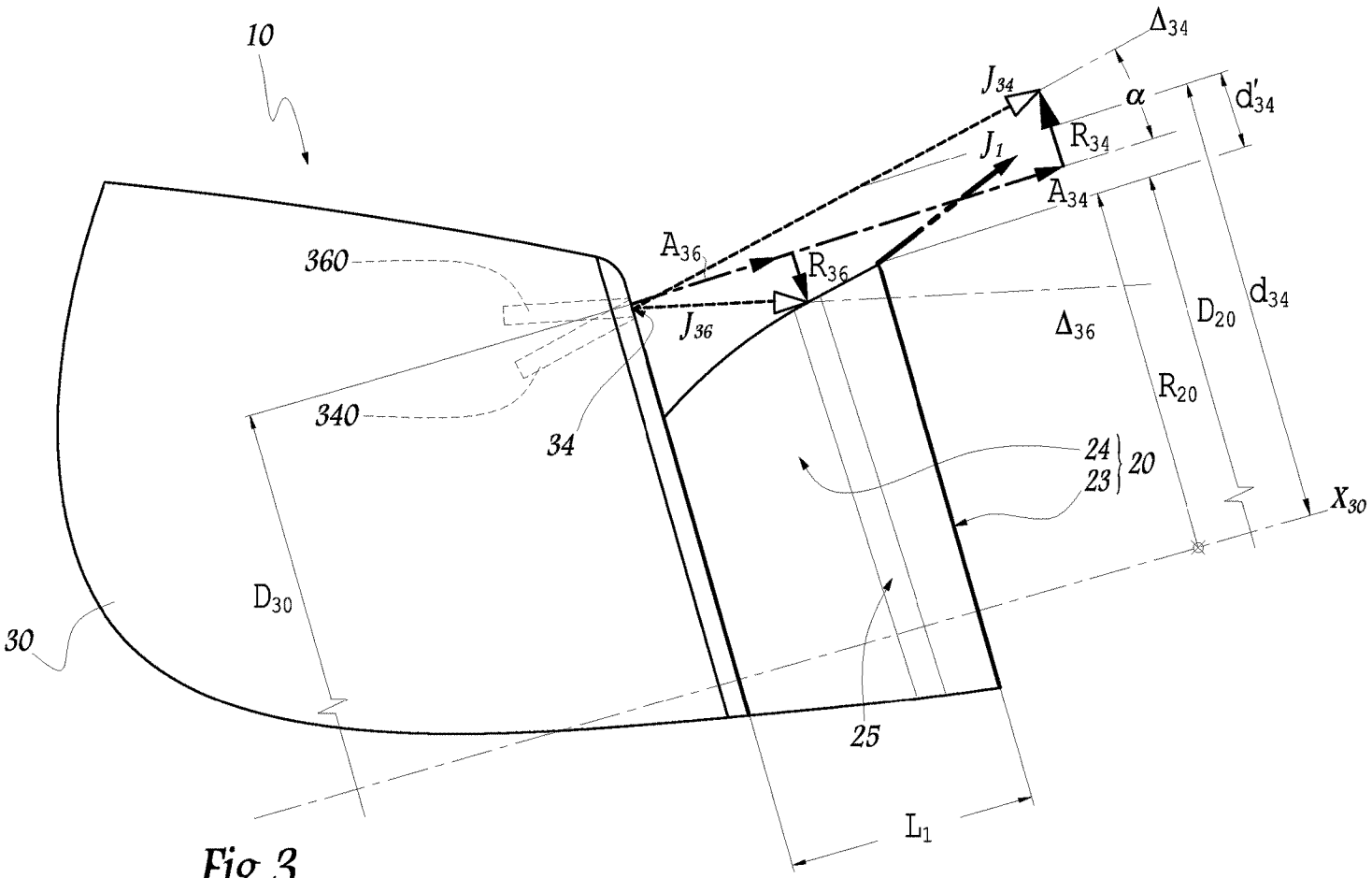
FIG. 3 is a partial side view of the projector of FIGS. 1 and 2.

The direction $\Delta_{34}$ has, with respect to the axis $X_{30}$, an axial component $A_{34}$ which can be seen in FIG. 3 which is not equal to zero and corresponds to the fact that the air exits the primary openings 34 towards the front of the projector, i.e. in the direction of the object O to be coated. This primary direction $\Delta_{34}$ also has a radial and centrifugal component $R_{34}$ which corresponds to the fact that the radial direction diverges from the axis $X_{30}$ by moving away from a primary opening 34.

The relative values of the components $A_{34}$ and $R_{34}$ are chosen in such a way that an angle $\alpha$, defined in the plane of FIG. 3 which is radial to the axis $X_{30}$, between these components has a value between 0 and 30°, more preferably between 3 and 18°.

Figure 4:
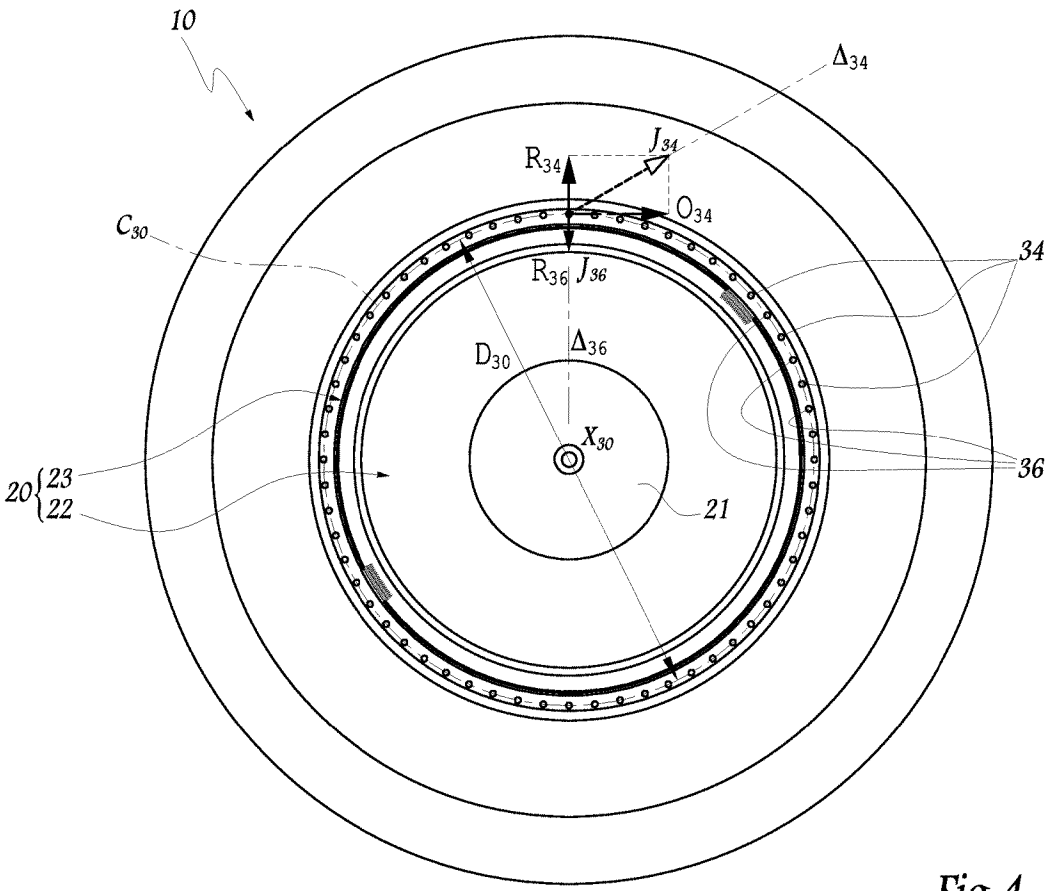
FIG. 4 is a front view of the projector of FIGS. 1 to 3.

The direction $\Delta_{34}$ also has an orthoradial component $O_{34}$ which can be seen in FIG. 4 which corresponds to the fact that the primary air jets 34 form a swirling skirt or "vortex".

$D_{20}$ denotes the nominal diameter of the bowl 20, i.e. the diameter of the spraying edge 23.

$D_{30}$ denotes the diameter of the circle C whereon the primary and secondary openings 34 and 36 are distributed. The diameter $D_{30}$ is greater than the diameter $D_{20}$. As such, in light of this difference in diameter and of the fact that the direction $\Delta_{34}$ has a radial and centrifugal component, a primary air jet $J_{34}$ that extends along a direction $\Delta_{34}$ passes, at the spraying edge 23 along the axis $X_{30}$, at a radial distance $d_{34}$ that is greater than the radius $R_{20}$ of the bowl 30, i.e. than half of the diameter $D_{20}$. Thanks to this orientation of the direction $\Delta_{34}$, a primary air jet can freely cross the region wherein the edge 23 is located.

In other words, the components $A_{34}$, $R_{34}$ and $O_{34}$ of the direction $\Delta_{34}$ of a primary jet $J_{34}$ allow this jet to flow at a radial distance $d'_{34}$ which is not equal to zero from the edge 23, with this radial distance corresponding to the difference between the radial distance $d_{34}$ and the radius $R_{20}$. This radial distance $d'_{34}$ can be between 0 and 25 mm and depends, among other items, on the value of the axial distance $L_1$.

Each secondary air jet $J_{36}$ is inclined, at the output of a secondary canal 36 and with respect to the rotational axis $X_{30}$, in a secondary direction $\Delta_{36}$ which has an axial component $A_{36}$ and a centripetal and radial component $R_{36}$. These axial and radial components are determined in such a way that the direction $\Delta_{36}$ hits the rear surface 24 of the bowl 20, as is shown in FIG. 3.

25 denotes an annular zone of the rear surface 24 that receives the secondary jets. From the zone 25, each secondary air jet spreads over the portion of the surface 24 located between the zone 25 and the edge 23. This makes it possible to generate a secondary flow of air in the form of a relatively uniform layer.

Thus, the jet $J_1$ of coating product exiting the edge 23 is subjected, on the one hand, to the primary air jets $J_{34}$, that each extend according to a direction $\Delta_{34}$ at a distance from the edge 23, and, on the other hand, to the secondary jets $J_{36}$, that lap against the surface 24 after having impacted the latter in the zone 25.

In light of the orientation of their directions $\Delta_{34}$, the primary air jets $J_{34}$ tend to dilate or expand radially, with respect to the axis $X_{30}$, the jet of coating product $J_1$. On the other hand, the secondary jets $J_{36}$ that lap against the rear surface 24 of the bowl 20 tend to drive back the jet $J_1$ of coating product in the direction of the axis $X_{30}$.

Under these conditions, the combined action of the primary jets $J_{34}$ and of the secondary jets $J_{36}$ has for effect to create a cloud of coating product, between the bowl 20 and the surface S, which has a relatively homogeneous speed profile, as shown by the profile P in FIG. 1.

As such, the axial distance $L_2$, measured between the edge 23 and the surface S parallel to the axis $X_{30}$ during the spraying of coating product can be retained at a low value, which guarantees a good transfer efficiency of deposit, while the impact width of the cloud of coating product on the surface S is high.

In practice, for a bowl of diameter $D_{20}$ between 50 and 100 mm, the distance $L_2$ is less than 200 mm, preferably less than 180 mm. Particularly satisfying results can be considered with a distance $L_2$ less than 150 mm. This is in particular the case during the implementation of an electrostatic sprayer with internal charge, i.e. by contact of the coating product with the bowl 20 which is electrically conductive and brought to high voltage. Alternatively, the invention can be used with a sprayer with external charge, with the same range of values for the distance $L_2$.

The flows of the primary $J_{34}$ and secondary $J_{36}$ jets and the rotation speed of the bowl 20 are chosen so that the speed of a droplet of paint exiting the edge 23 is greater than 5 m/s.

The speed of displacement of the sprayer 20 perpendicularly to the axis $X_{30}$, as shown by the double arrow F in FIG. 1, is between 0.2 and 2 m/s. In light of the "robustness" of the cloud of coating product at the output of the bowl 20, the relatively fast speed of displacement does not risk deforming or rendering this cloud inhomogeneous, in such a way that the deposit of coating product on the surface S is regular.

The installation 1 can comprise means for determining the distance $L_2$, by measurement or by calculation and this distance can be taken into account in order to adjust the value of the high voltage applied to the coating product, in particular by the intermediary of the bowl 20 which is electrically conductive. More precisely, the setpoint value for the high voltage delivered by the unit 50 can be set to a nominal value U such that the ratio $U/L_2$, which corresponds to the average electrostatic field between the edge 23 and the object O, is constant when the distance $L_2$ varies.

Entirely advantageously, and in light of the relatively low value of the distance $L_2$, the nominal value of the high voltage used to electrostatically charge is selected as less than 80 kV. In light of the relatively low value of the distance $L_2$, the electrostatic field between the bowl 20 and the object O is intense, with the same level of intensity as in conventional installations, while still using voltage values that are lower than usual and by decreasing, consequently, the risk of fire as the capacitive energy stored is proportional to the square of the nominal high voltage delivered by the unit 50.

In practice, the value of the high voltage U is chosen according to that of the distance $L_2$ in such a way that the ratio $U/L_2$ is approximately 3 kV/cm. This value is advantageously between 1 kV/cm and 4 kV/cm.

Although it is particularly advantageous to use both primary air jets $J_{34}$ and secondary air jets $J_{36}$ with the projector and the method of the invention, the use of secondary air jets is optional in that, in light of the orientation of the direction $\Delta_{34}$, the primary air jets provide as a main principle the function of conformation of the jet $J_1$ of coating product exiting the bowl.

The invention claimed is:

1. A rotating projector for a coating product, comprising:

a spraying bowl of the coating product having at least one circular spraying edge, a turbine for driving the spraying bowl around a rotational axis, a body that defines the rotational axis and which comprises primary openings arranged on a primary contour surrounding the rotational axis, wherein each primary opening is intended for injecting a primary air jet in a primary direction having, with respect to the rotational axis, an axial component and an orthoradial component which are not equal to zero, the primary direction has a radial component which is not equal to zero and which is centrifugal with respect to the rotational axis, at a location along the rotational axis of the spraying bowl where the primary air jet crosses the at least one circular spraying edge of the spraying bowl, the primary air jet is at a radial distance from the rotational axis that is greater than the radius of the at least one circular spraying edge for expanding a jet width of the coating product being projected, the body comprises secondary openings arranged on a secondary contour surrounding the rotational axis, each secondary opening being intended for ejecting a secondary air jet in a secondary direction having, with respect to the rotational axis, an axial component and a centripetal radial component which are not equal to zero, such that the secondary jet hits an external surface of the spraying bowl, the primary and secondary contours of the primary and secondary openings coincide with a circle centered about the rotational axis, and the primary direction forms, in a plane radial with respect to the rotational axis, a diverging angle between 3° and 12°.

2. A method for spraying the coating product onto a surface of an object to be coated, using the rotating projector according to claim 1, wherein, during spraying, the coating product sprayed from the at least one circular spraying edge is subjected to the action of primary jets exiting from primary openings arranged on the primary contour, with these primary jets each being directed in the primary direction having, with respect to the rotational axis, the axial component and the orthoradial component which are not equal to zero, the primary direction has the radial component which is not equal to zero and centrifugal with respect to the rotational axis and the primary direction forms, in the radial plane and with respect to the rotational axis, the angle between 3° and 12°, the primary jet extends, at the at least one circular spraying edge and along the rotational axis, at a distance that is greater than the radius of the at least one circular spraying edge, the diameter of the at least one circular spraying edge is between 50 and 100 mm, the at least one circular spraying edge is arranged at an axial distance from the object to be coated, measured parallel to the rotational axis, which is less than 200 mm, during spraying, the coating product is subjected to the action of secondary air jets exiting from secondary openings arranged on the secondary contour coinciding with the primary contour and with the circle centered about the rotational axis, with these secondary jets each being directed in the secondary direction having, with respect to the rotational axis, the axial component and the centripetal radial component which are not equal to zero, with the secondary jets hitting an external surface of the spraying bowl.

3. The method according to claim 2, wherein a total flow of the primary jets is between 100 and 500 liters/mn.

4. The method according to claim 3, wherein a total flow of the secondary jets is between 100 and 500 liters/mn.

5. The method according to claim 2, wherein a flow of the primary jets, a flow of the secondary jets, and a rotation speed of the spraying device are adjusted in such a way that a speed of the droplets of the coating product exiting the at least one circular edge is greater than 5 m/s and in that a speed of displacement of the projector with respect to the surface of the object to be coated is between 0.2 and 2 m/s.

6. The method according to claim 2, wherein the at least one circular spraying edge is arranged at an axial distance from the object to be coated, measured parallel to the rotational axis, which is less than 180 mm.

7. The method according to claim 6, wherein the at least one circular spraying edge is arranged at an axial distance from the object to be coated, measured parallel to the rotational axis, which is less than 150 mm.

* * * * *